United States Patent [19]

Bergquist

[11] 4,345,144

[45] Aug. 17, 1982

[54] SAFETY LATCH CONTROL ARRANGEMENT FOR SELF-CLEANING OVEN

[75] Inventor: Frank H. Bergquist, Elmhurst, Ill.

[73] Assignee: Harper-Wyman Company, Hinsdale, Ill.

[21] Appl. No.: 259,849

[22] Filed: May 4, 1981

Related U.S. Application Data

[62] Division of Ser. No. 113,734, Jan. 21, 1980, Pat. No. 4,340,806.

[51] Int. Cl.[3] ..... H05B 1/02; F24C 7/08

[52] U.S. Cl. ..... 219/413; 219/10.55 R; 219/398; 219/414; 126/197

[58] Field of Search ..... 219/10.55, 390, 391, 219/392, 393, 394, 395, 396, 397, 398, 399, 412, 413, 414, 491; 126/196; 292/113, 119

[56] References Cited

U.S. PATENT DOCUMENTS

| | | | |
|---|---|---|---|
| Re. 26,943 | 8/1970 | Barber | 219/413 |
| Re. 26,944 | 8/1970 | Getman | 219/413 |
| 2,470,043 | 5/1949 | Monsarrat | 34/45 |
| 3,214,567 | 10/1965 | Chisholm | 219/398 |
| 3,387,874 | 6/1968 | Holtkamp | 219/413 |
| 3,469,568 | 9/1969 | Torrey et al. | 126/197 X |
| 3,549,862 | 12/1970 | Holtkamp | 219/413 X |
| 3,569,670 | 3/1971 | Eff | 219/413 |
| 3,610,883 | 10/1971 | Holtkamp | 219/413 |
| 3,655,943 | 4/1972 | Holtkamp | 219/491 |
| 3,823,294 | 7/1974 | Takayama et al. | 219/10.55 R |
| 3,875,372 | 4/1975 | Gilliom | 219/413 |
| 3,894,214 | 7/1975 | Staples | 219/394 |
| 4,013,312 | 3/1977 | DeWeese | 292/113 |
| 4,101,750 | 7/1978 | Doner | 219/10.55 C |
| 4,109,637 | 8/1978 | Drovin | 126/197 |

*Primary Examiner*—Volodymyr Y. Mayewsky
*Attorney, Agent, or Firm*—Mason, Kolehmainen, Rathburn & Wyss

[57] ABSTRACT

A latch control arrangement for a self-cleaning oven or similar thermostatically controlled apparatus is provided to efficiently and safely control the locking and unlocking of the oven door. The self-cleaning oven is of the type that includes an oven temperature control circuit having a sensing element arranged to sense the temperature of the oven cavity. The oven temperature control circuit is responsive to manually operable selector arrangements of the oven including oven temperature and oven mode selection arrangements. In one arrangement, the oven controls are provided by a rotatable selector control. The latch control arrangement in one embodiment includes a locking member to lock a manually operable oven door latch. A locking member verification switch is provided to sense the portion of the locking member that extends into interfering relationship with the latch member. The locking member verification switch is disposed such that actuation of the verifications switch can only occur when the locking member is in the interfering, latch-locking position.

11 Claims, 3 Drawing Figures

SAFETY LATCH CONTROL ARRANGEMENT FOR SELF-CLEANING OVEN

This is a division of application Ser. No. 113,734, filed Jan. 21, 1980, now U.S. Pat. No. 4,340,806.

CROSS-REFERENCE TO RELATED APPLICATIONS

This application is directed to improvements in latch control arrangements for self-cleaning oven control arrangements as disclosed in co-pending U.S. application Ser. No. 113,733 filed by C. J. Schmitz on Jan. 21, 1980, now U.S. Pat. No. 4,316,079.

BACKGROUND OF THE INVENTION

A. Field of the Invention

The present invention relates generally to the field of basic process function controllers, thermostatically controlled apparatus and oven control arrangements and more particularly to latch control apparatus for self-cleaning ovens.

B. Description of the Prior Art

Various arrangements of the prior art provide control arrangements for the locking of the oven door of a self-cleaning oven during the self-clean cycle and when the oven temperature is above a predetermined temperature.

These prior art arrangements include various door latching arrangements and control circuits for controlling the locking and unlocking of the oven door.

U.S. Pat. No. 4,109,637 discloses a locking mechanism for the door of a self-cleaning oven including a latch arm movable between a door locking position and a door unlocked position with a pair of solenoids coupled to the rear of the latch arm by a respective movable magnet bar. The magnet bars are simultaneously displaced for each separate energization of the solenoids. One of the solenoids in energized to move the latch arm to the locked position at the start of the clean cycle. The second solenoid is energized after the clean cycle when the oven temperature has dropped below 550° F. to move the latch arm to the unlocked position. Separate thermostat contacts from the oven thermostat are utilized to control the second solenoid that moves the latch arm to the unlock position. A switch is provided for each solenoid and is disposed and operated by the movable magnet bar of each respective solenoid. The contact state of each switch is determined by and each switch is directly actuated by the position of each respective solenoid magnet bar. The switches control the connection of the electrical supply to the respective solenoid coils for energization of the respective solenoids. Thus, the position of each solenoid magnet bar is utilized along with the timer circuit and the unlock thermostat to energize and de-energize each solenoid.

U.S. Pat. No. 3,469,568 discloses a latch control arrangement and self-clean control circuit including a latch position switch 100 disposed to be actuated by the engagement of a lock member 90 that moves to lock a latch striker 71. The switch 100 is incorporated into the self-clean control circuit to enable the self-clean mode. A latching rod 94 is provided to latch the lock member 90 in the latched position and to prevent the unlocking of the oven door by restricting the movement of the lock member 90. The latching rod 94 is withdrawn from interfering relationship with the lock member 90 by an unlock arrangement including thermostatic contacts 44 on the thermostat AT and an unlock solenoid 110. Thus, the switch 100 does not measure the position of the latching rod 94 that prohibits the unlocking of the oven door during the self-cleaning cycle.

U.S. Pat. No. 3,823,294 in FIG. 5 discloses a door locking system including a solenoid actuated lock means 22 that protrudes into a lock groove 25 in the door 21. A switch 3 including an actuating lever 26 is contacted by the rear end of the solenoid core opposite the lock means 22 to sense the locked position of the lock means 22. In FIG. 6, another door lock structure is disclosed including an electromagnetically driven, rotatable latch 28. The latch 28 includes a hook 30 for latching engagement within a recess position 32 of the oven door 21. A switch 3 senses movement of the rear end of the latch 28 opposite the hook portion 30. A second switch 9 functioning as an emergency stop switch includes a switch actuator 37 operable by an operating button 39 and a push bar 38.

U.S. Pat. No. 4,013,312 discloses a door latch assembly including a locking plate 40 having an edge portion 91 that engages and operates a switch 90. The switch 90 is connected in a power supply circuit. A locking rod 66 is positionable to prevent movement of the locking plate when a locking finger 65 of the locking rod 66 engages an abutment 71 of the locking plate 40.

U.S. Pat. No. 4,101,750 discloses a door interlock system for use with a microwave oven and including a slider member 58 movable between released and interlocking positions. A primary door interlock switch 27 and a secondary door interlock switch 24 are actuated when the door is in the closed, latched position and incorporated in the microwave control circuitry. A monitor switch 28 is provided and is actuated by a latch arm 82. A latch arm 81 actuates the secondary interlock switch 24. The primary interlock switch 27 is operated by a movable arm 72 that rotates in response to movement of the handle 15. The latch arms 81 and 82 are fixed to a bar attached to the door 14. The slider 58 is moved to the latching position by operation of the handle 15 wherein slider pins 60, 61 engage the latch arms 82, 81 respectively to latch the door.

While the prior art arrangements referred to hereinbefore are generally suitable for their intended use, the prior art arrangements do not provide for the direct verification of the locking member of an oven control circuit being in locked engagement with a latch member by means of a locking member verification switch actuated by the locking portion of the locking member that engages the latch member and prevents movement thereof. Without the direct verification of the position of the locking member, inaccurate sensed conditions of the locked condition of the oven door can result in undesirable operating modes without the secure locking of the oven door. Further, the prior art arrangements do not provide an automatic safety latch control arrangement utilizing efficient and reliable energization arrangements to control the automatic locking and unlocking of the oven door and control circuitry that directly senses the operation of the latch arrangement, the mode position of the latch arrangement and the position of the oven door to ensure proper operation.

SUMMARY OF THE INVENTION

Accordingly, it is a principal object of the present invention to provide an improved door latching arrangement for an oven or similar thermostatically controlled apparatus that directly senses the locked position of a locking member that locks a door latch arrangement by the provision of a switch that is contacted by a portion of the locking member that prohibits movement of and locks the latch arrangement.

It is another object of the present invention to provide an improved automatic door locking arrangement for thermostatically controlled apparatus and process control apparatus wherein an actuating means is provided for each of two separate locking and unlocking functions with movement of a locking member by control circuitry being provided to sense the position of the locking arrangement and the door positions.

Briefly and in accordance with the principles of the present invention, a latch control arrangement for a self-cleaning oven or similar thermostatically controlled apparatus is provided to efficiently and safely control the locking and unlocking of the oven door. The self-cleaning oven is of the type that includes an oven temperature control circuit having a sensing element arranged to sense the temperature of the oven cavity. The oven temperature control circuit is responsive to manually operable selector arrangements of the oven including oven temperature and oven mode selection arrangements. In one arrangement, the oven controls are provided by a rotatable selector control. The latch control arrangement in one embodiment includes a locking member to lock a manually operable oven door latch. A locking member verification switch is provided to sense the portion of the locking member that extends into interfering relationship with the latch member. The locking member verification switch is disposed such that actuation of the verifications switch can only occur when the locking member is in the interfering, latch-locking position. In another embodiment, the latch control arrangement includes a door locking member that is controlled to a locking position by the momentary energization of a first actuator and controlled to the unlocking position by the momentary energization of a second actuator. The first actuator is automatically energized to release the locking member from a predetermined unlocked position in which the locking member is latched when the oven controls are set to the self-clean position and the oven door is in a closed position. The first actuator is de-energized automatically by a door latch verification switch positioned to sense the locking member being in a door locking position. The locking member is released from the unlocked position only if the oven door is closed. The second actuator is automatically energized to move the locking member from the locking position to the unlocked latched position only if the oven controls are set to a predetermined mode and the oven temperature is below a predetermined safe operating level. The second actuator is de-energized upon the sensing of the locking member being reset into the unlocked, latched position.

These and other objects of the present invention will become apparent from the accompanying detailed description taken in conjunction with the accompanying drawings.

DESCRIPTION OF THE PREFERRED EMBODIMENT

Figure 1:
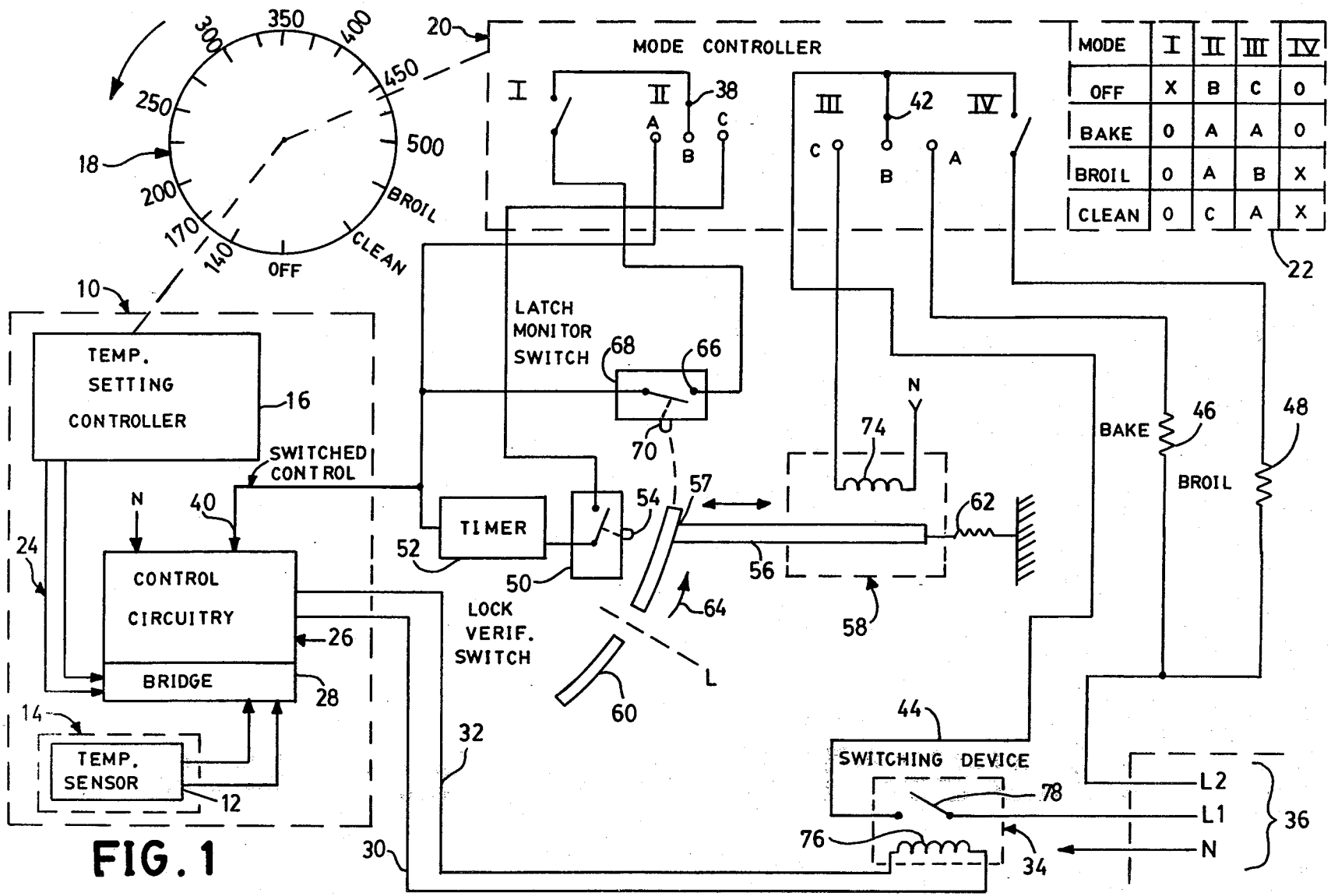
FIG. 1 is a block diagram schematic representation of the control arrangement and portions of a self-cleaning oven in accordance with the principles of the present invention.
Figure 2:
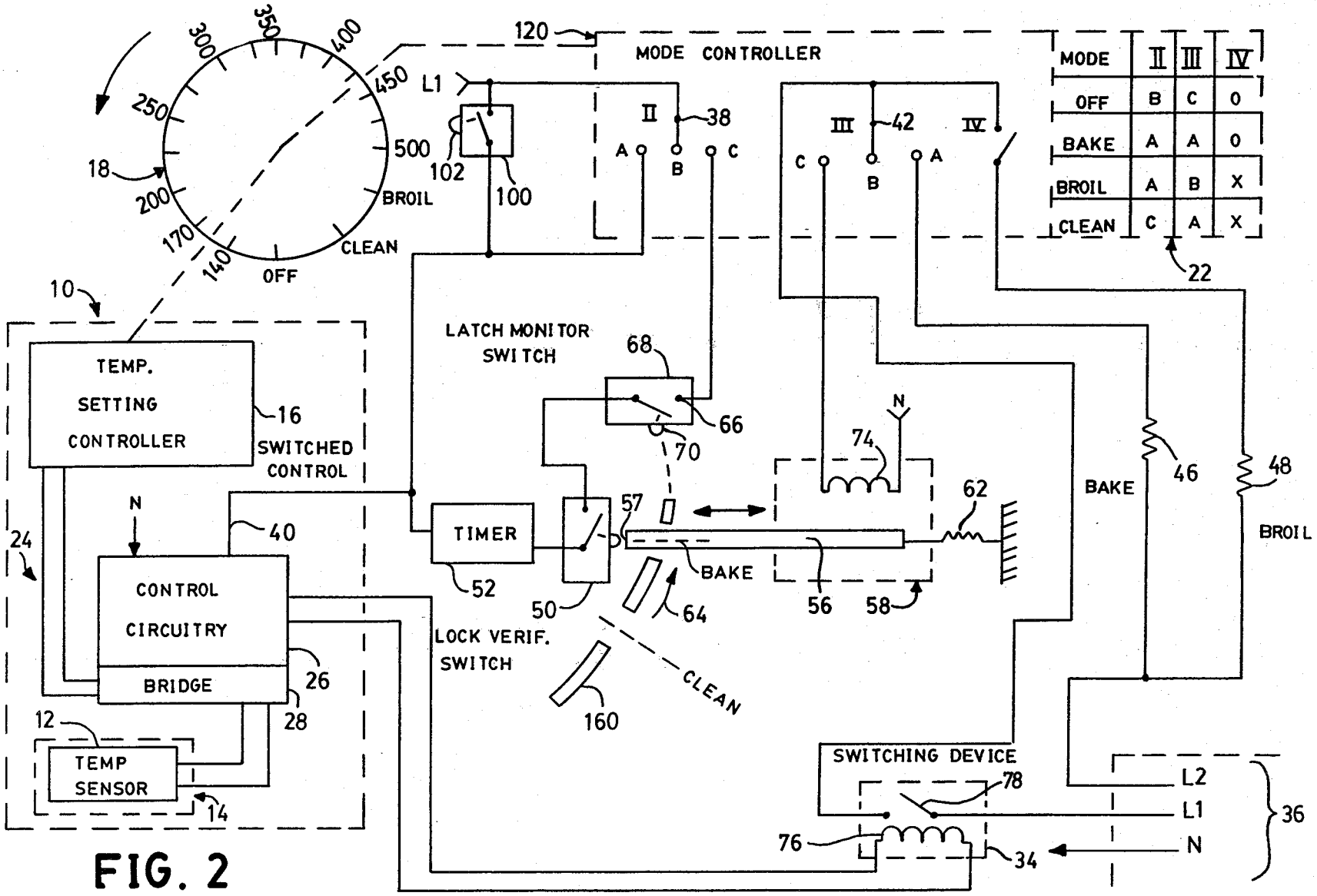
FIG. 2 is a schematic block diagram representation of an alternate arrangement of the present invention of FIG. 1.
Figure 3:
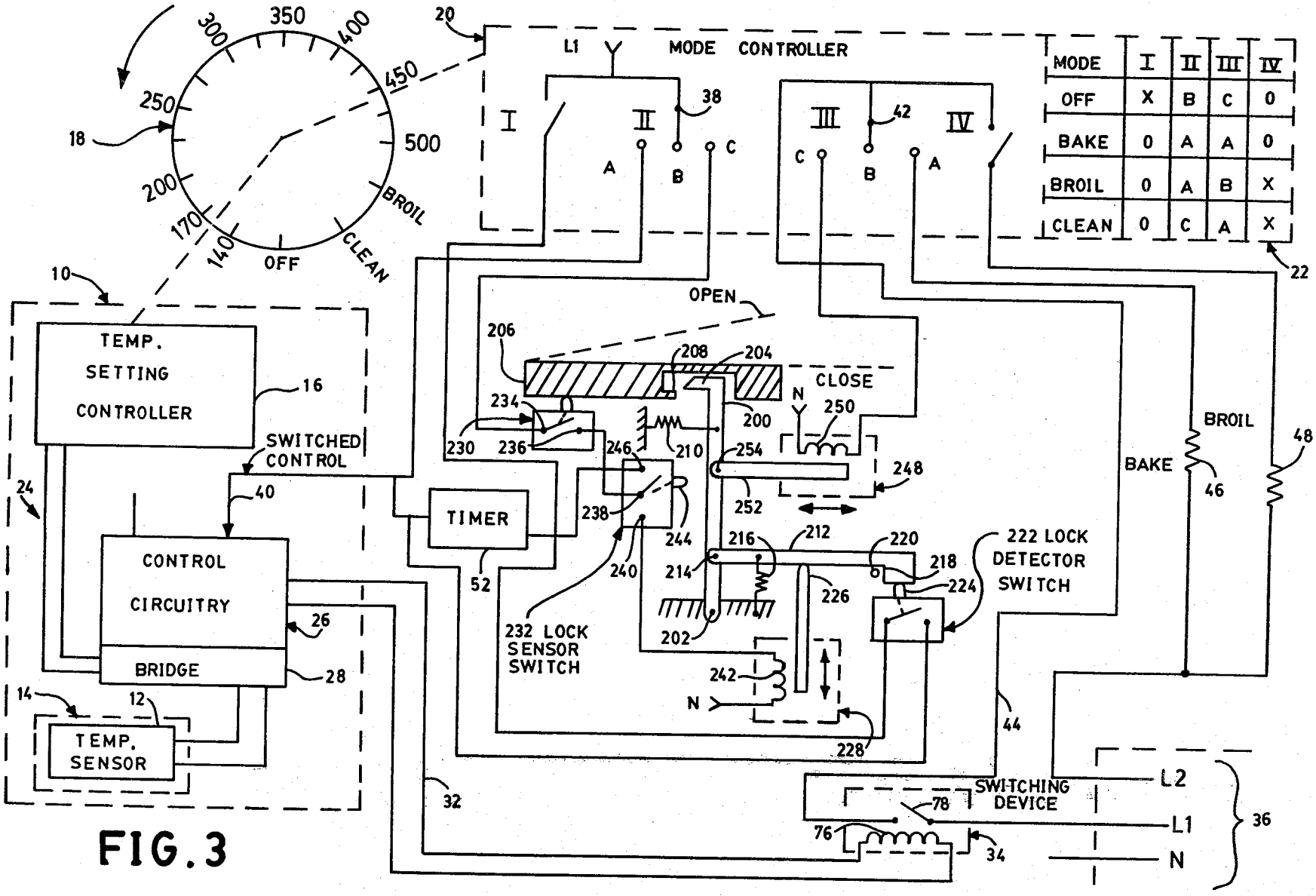
FIG. 3 is a block diagram schematic representation of another alternate arrangement of the control arrangement of the present invention of FIGS. 1 and 2.

The control arrangement in accordance with the principles of the present invention of FIG. 1 is shown in connection with various portions of a self-cleaning oven. However, it should be understood that the control arrangement of the present invention is also useful in connection with other thermostatically controlled apparatus and also with apparatus having a controlled closure device and a basic controlled apparatus function. Referring additionally to FIGS. 2 and 3, alternate arrangements of the control arrangement of the present invention are illustrated in connection with portions of self-cleaning ovens. The elements and apparatus of FIGS. 1 through 3 that are identified by identical reference numerals refer to identical elements and apparatus.

The control arrangement of FIG. 1 includes an electronic thermostat controller 10 having a temperature sensor element 12 that is disposed in an oven cavity referred to generally at 14 to sense the temperature of the oven cavity at a predetermined appropriate oven cavity location. The electronic thermostat controller 10 also includes a temperature setting controller device 16 that is coupled to and responsive to a manually operable temperature and oven mode selector referred to generally at 18. The selector 18 includes a predetermined number of circumferentially arranged temperature setting positions for normal cooking temperatures in the range of 140°–500° F., for example. The selector 18 also includes off, clean, and broil positions. In a preferred arrangement, the off, clean and broil mode positions of the selector 18 are detented to provide accurate and reliable positioning.

A mode controller 20 is operatively coupled to the selector 18 and includes switch arrangements identified as I, II, III and IV and appropriately operated in a predetermined manner in response to the setting of and the rotation of the selector 18. In a specific arrangement, various shaped and disposed cams (not shown) are arranged on a common shaft with the selector 18 to appropriately operate the mode controller switches I, II, III and IV to provide various operational oven modes as indicated in the mode controller table 22 and as will be discussed in more detail hereinafter.

The selector 18 when set to the various temperature set points controls an appropriate parameter of the temperature setting controller 16. In a preferred arrangement the temperature setting controller 16 includes a resistance array such that a predetermined resistance is connected at the output 24 of the temperature setting controller 16 in response to each of the respective temperature setting positions of the selector 18. The resistance setting output 24 of the temperature controller 16 is connected to a control circuitry stage 26 of the electronic thermostat controller 10. In a specific embodiment, the control circuitry stage 26 includes a bridge circuit stage referred to generally at 28 into which the resistance output 24 of the temperature setting controller 16 is connected.

The temperature sensor 12 is also connected to the bridge circuitry 28. In a specific arrangement, the temperature sensor 12 and the resistance of the temperature setting controller 16 are connected in a common leg of the bridge circuit 28. The bridge circuit 28 is connected to the control circuitry 26. The control circuitry 26 develops control signals at 30 and 32 in response to the balanced and unbalanced conditions of the bridge 28 of the control circuitry 26. The control signals 30, 32 of the control circuitry stage 26 are connected to selectively operate a switching device referred to generally at 34.

In the case of an electrical self-cleaning oven as illustrated in FIG. 1, a three wire power source connection to a suitable 110 or 220 volt source referred to generally at 36 is connected to the oven and includes power supply lines L1 and L2 and a neutral line N. The L1 power line is connected to the switches I and II of the mode controller 20. The switch II is a three position switch including contact positions A, B and C with a common contact 38 being connected to the power line L1. The A position contact of the switch II is connected to a switch control line 40 as a switched control input to the control circuitry 26. The neutral line N is also connected to the control circuitry 26.

The control circuitry 26 is arranged to output control signals on the output lines 30 and 32 in accordance with predetermined relationships of the bridge 28 when the switch control line at 40 is active. Referring now to the mode controller table 22, the selector 18 upon rotation to the broil position or to any of the temperature set positions actuates the switch II to the switch position A and thus the power line L1 is connected to the switch control line input at 40 to the control circuitry 26.

The switching device 34 is actuated in response to predetermined control signals on lines 30 and 32 to connect the power line L1 to the switches III and IV of the mode controller 20. The switch III of the mode controller 20 is a three position switch having switch contact positions A, B and C and a common contact 42 connected to the output 44 of the switching device 34. The A contact position of the switch III is connected through a bake heater element 46 to the L2 power line. The switch IV is a single-pole, single-throw switch having one contact connected to the output 44 of the switching device 34 and the second contact connected through a broil heating element 48 to the L2 power line. The switch III in accordance with the table 22 is actuated to the A position when the selector 18 is positioned to the clean mode position or any of the temperature set points. Further, the switch IV is closed when the selector 18 is in the broil and clean mode positions and is opened when the selector 18 is in the off position or any of the temperature set positions of the selector 18.

Thus, in operation, and with the selector 18 set to any of the temperature set point positions, the electronic thermostat controller 10 selectively actuates the switching device 34 and the bake element 46 in response to the sensed temperature from the temperature sensor 12 to maintain the desired oven operating temperature as selected on the selector 18. With the selector 18 in the broil mode position, the broil heating element 48 is controlled through the switching device 34 by the electronic thermostat controller 10 to maintain an appropriate broiling temperature in response to the temperature sensor 12.

Considering now the self-clean mode denoted as clean in FIG. 1 and with the selector 18 in the clean position, the electronic thermostat controller 10 by means of the temperature setting controller 16, the control circuitry 26 and the temperature sensor 12 appropriately controls the temperature of the oven cavity at a predetermined clean temperature, for example, 900° F. Further, the selector 18 when positioned in the clean mode actuates the switch II to the C position and the switch III to the A position. Further, the switch IV is closed during the clean mode.

The contact C of the switch II is connected through a single-pole, single-throw lock verification switch 50 and a timer 52 to the switched control line 40. The lock verification switch 50 is actuated by a switch actuator 54 that is arranged to be contacted by a locking member 56 of a locking actuator device 58.

An oven door latch referred to generally at 60 represents the door latching device of a typical self-cleaning oven and is arranged to be pivoted or rotated to an oven door latching position by movement of a door latch handle or similar actuator. The locking member 56 is biased to the left in FIG. 1 by a spring 62 into engagement with the door latch 60 when the oven door is in the open position. The door latch 60 in conventional self-cleaning ovens is arranged to be moved to a door latching position upon operation of the door latch handle only when the oven door is in a closed position. For example, reference may be made to U.S. Pat. Nos. 4,013,312, 3,469,568 and 3,362,398 for a more detailed disclosure of typical latching arrangements of self-cleaning ovens.

In any case, with the oven door closed and the door latch handle in the door closed position, the door latch 60 is rotated from the position as shown in FIG. 1 in the direction of the arrow 64 to a position wherein the locking member 56 passes through the door latch member 60 to contact the switch actuator 54 with the reference line L being aligned with the locking member 56 and the switch actuator 54. With the oven in the door latching position and in the latch locking position by means of the locking member 56 passing through the latch member 60, the oven door is incapable of being opened and the door latch handle is incapable of being operated due to the locking member 56 prohibiting motion of the latch member 60. It should be noted that the switch actuator 54 of the lock verification switch is contacted by a portion 57 of the locking member 56 that extends through the latch member 60 to ensure locking of the latch 60 before actuation of the switch 50.

Upon the switch actuator 54 being contacted by the locking member 56, the contacts of the lock verifications switch 50 are closed. With the selector 18 in the clean position and the timer 52 set to perform the clean timing mode function, the actuation of the switch 50 provides a circuit path from the L1 power line through the switch contact C of switch II to the switched control line 40 of the control circuitry 26.

Thus, during the operational time of the timer 52, the electronic thermostat control 10 through the switching device 34 selectively energizes the bake and broil heating elements 46 and 48 respectively to maintain the oven cleaning temperature of approximately 900° F. Further, during the clean cycle, the oven door is incapable of being opened because the door handle is incapable of being operated due to the interference of the locking member 56 with the door latch 60.

After termination of the oven cleaning cycle, if the operator wishes to open the oven door, the selector 18 is rotated to the off position to actuate the switch I. The switch I when closed connects the L1 power line to a contact 66 of a door latch monitor switch 68. The door latch monitor switch 68 is a single-pole, single-throw switch having a switch actuator 70 that is arranged to be contacted by a portion of the door latch member 60 when the oven door is closed and the latch member 60 is positioned to the latched position. The door latch switch 68 and the switch I connect the L1 power line to the switched control line 40.

With the selector 18 in the off position, the temperature setting controller 16 is conditioned to provide an appropriate resistance at 24 representing a predetermined monitor temperature of 625°, for example, to the electronic thermostat controller 10. Further, with the selector 18 in the off position, the switch III is actuated to the C contact position. The C contact position of the switch III is connected over an energizing signal line to the locking actuator device 58. The locking actuator device 58 when energized by the switching device 34 controls movement of the lock member 56 to the right in FIG. 1. In a specific embodiment, the locking actuator device 58 is a solenoid and the C contact of the switch III is connected to one side of a solenoid coil 74. The other end of the solenoid coil 74 is connected to the N power line.

With the selector 18 set to the off position and the door latch 60 in a latched position, the control circuitry 26 is actuated over the switch control line 40. The control circuitry 26 energizes the switching device 34 to connect the L1 power line through the switch III to energize the locking actuator device 58 if the temperature in the oven cavity is below 625° F. If the temperature in the oven cavity is below 625°, the locking actuator device 58 is energized through the solenoid coil 74 and the locking member 56 is withdrawn from the interfering position with the latch member 60 thus allowing the door handle and latch member 60 to be moved to the open position and the oven door is capable of being opened. When the operator opens the door latch to the open or unlatched position, the switch 68 is deactuated and thus the unlock control path to the locking actuator device 58, through the electronic thermostat control 10, the switching device 34, and the switch III is also deactuated.

In a specific embodiment, the switching device 34 is a relay having a relay coil 76 connected to the control lines 30 and 32 of the control circuitry 26. A single-pole, single-throw switch 78 of the relay 34 is controlled by the actuation of the relay coil 76 to connect the L1 power line to the common contact 42 of the switch III over the connection 44.

Referring now again to FIG. 2 and considering an alternative control arrangement to the control arrangement of FIG. 1, the control arrangement of FIG. 2 provides a momentary actuated, door unlock switch 100 and the control arrangement of FIG. 2 is utilized to provide the locking of a door latch member 160 in both the bake and clean oven modes of operation. A mode controller 120 is provided in the oven control arrangement and includes the switches II, III, and IV of the mode controller 20 of FIG. 1.

The latch member 160 includes two lock member accepting and alignment positions for the bake and clean modes of operation respectively. Thus, the latch member 160 is arranged to provide for the passage of the locking member 56 to actuate the switch 50 when the door latch handle is in the normal cooking position denoted by the reference line BAKE of FIG. 2. Further, the latch member 160 is also arranged to provide for the passage of the locking member 56 when the door latch 160 is moved by the door latch handle to a closed or latch position for a clean mode of operation as denoted by the reference line CLEAN. Further, and as in FIG. 1, the door latch 160 is arranged to contact and actuate the latch verification switch 68 when the latch member 160 is rotated to the clean position. As shown in FIG. 2, the door latch member 160 does not actuate the switch 68 in the normal cooking position even though the locking member 56 is in the locked position with respect to the door latch 160 in the normal cooking modes.

Similarly to the control arrangement of FIG. 1, the control arrangement of FIG. 2 in the clean mode of operation controls the bake and broil heating elements 46 and 48 respectively to maintain an oven temperature of 900° F. by means of the oven thermostat controller 10; the control circuitry 26 being energized over the switched control line 40 through the timer 52, the lock verification switch 54 and the latch verification switch 68 by means of the L1 power line connected through the contact C of the switch II.

After a self-cleaning mode of operation and to allow the oven door to be unlatched, the selector 18 is moved out of the clean position to the off position and as in FIG. 1 the temperature setting controller 16 conditions the oven thermostat controller 10 to actuate the switching device 34 only when the temperature in the oven cavity is below 625° as sensed by the temperature sensor 12. Further, to unlock the door handle latch, the operator pushes the actuator control 102 of the unlock switch 100 provided on the oven controls to connect the L1 power line over the switch 100 to the switch control line 40 to activate and energize the control circuitry 26.

If the oven temperature is below 625°, the actuation of the switch 100 will energize the switching device 34 through the contact C of the switch III. Consequently, the locking member actuator 72 will be energized to withdraw the locking member 56 from the interferring position with the latch 160, thus allowing the door handle latch to be moved to the open position and the door opened.

Similarly, with the oven in the normal cooking modes, the locking member 56 is in interferring engagement with the latching member 160 and an operator may initiate unlocking of the door handle latch by actuation of the switch 100 after the selector 18 has been moved to the off position. In an alternate embodiment, the switch 100 is operated by the selector 18 in a door unlock mode position of the selector 18.

Referring now to FIG. 3, the electronic thermostat controller 10, the selector 18, the mode controller 20, the switching device 34, and the bake and broil heating elements 46 and 48 are identical to like identified elements and apparatus of FIG. 1 and operate in the control arrangement of FIG. 3 to provide a safety interlock control as discussed hereinbefore in connection with FIGS. 1 and 2.

The oven latching arrangement of FIG. 3 provides a safety interlock control and includes a latching member 200 that is pivotally mounted at 202 to the oven frame. The latching member includes a latching hook 204 at one extreme end adjacent an oven door 206. When the latching member 200 is in the oven door latching position, the hook 204 engages a hook receiving portion of the oven door 206 at 208 to latch the door in a closed, latched and locked position.

In the arrangement of FIG. 3, the oven structure is not provided with a door latch operating handle. Thus, the control arrangement of FIG. 3 automatically provides the total control of the latching and locking member 200. The locking member 200 is biased to the door locking position by a spring 210 connected between the locking member 200 and the oven frame. A locking link member 212 is pivotally connected at pivot point 214 to one end of the locking member 200. The locking link member 212 is biased by a spring 216 in a clockwise direction in FIG. 3. In the unlocked position of the locking member 200, the locking member 200 is latched by the locking link member 212 by the engagement of an extending portion 218 of the locking link member 212 with a latching pin 220 fixed to the oven structure. A single-pole, single-throw lock detector switch 222 includes a switch actuator 224 positioned to be engaged by the locking link member 212. The switch 222 is in a closed contact condition when the locking member 200 is in the unlocked position with the locking link member 212 engaging the switch actuator 224.

An actuator member 226 of a solenoid lock actuator 228 is arranged to contact the locking link member 212. Upon energization of the solenoid lock actuator 228, the locking link member 212 is pivoted upward in a counter-clockwise direction around the latching pin 220 to release the locking link member 212 and to allow the locking member 200 to pivot in a counter-clockwise direction to lock the oven door 206 when the oven door is in a closed position.

The switch contact C of the switch II is connected through a single-pole, single-throw door closure sensor switch 230 and a single-pole, double-throw locking member sensor switch 232 to energize the solenoid actuator 228. Specifically, the contact C of the switch II is connected to a first contact 234 of the door sensor switch 230. The second contact 236 of the door sensor switch 230 is connected to the common contact 238 of the locking member sensor switch 232. One contact 240 of the locking member sensor switch 232 is connected through a solenoid coil 242 of the solenoid actuator 228 to the N power line. The locking member sensor switch 232 includes a switch actuator 244 which is contacted by the locking member 200 when the locking member is in the door locking position to actuate the locking member sensor switch 232 to an open contact position with respect to the contact 240. In the locked position of the locking member 200, the common contact 238 of the switch 232 is actuated to a closed contact position with respect to a second contact 246 of the single-pole, double-throw switch 232. Correspondingly, when the locking member 200 is in the unlocked position as shown in FIG. 3, the switch 232 is in a closed contact position with respect to the contact 240 and an open contact position with respect to the contact 246.

With the selector 18 set to the clean position and the switch II being actuated to the C contact position, if the oven door 206 is in the door closed position, a circuit path is established between the L1 power line through the door sensor switch 230 and the locking member sensor switch 232 to energize the solenoid actuator 228 to release the locking link member 212 and to allow the locking member 200 to move to the door locked position. Upon the locking position of the locking member 200 being sensed by the switch 232, the circuit path to the solenoid actuator 228 is opened via the switch 232 and the solenoid coil 242 is de-energized. With the locking member 200 in the locked position and the switch actuator 244 being contacted by the locking member 200, the sensor switch 232 provides a circuit path from the L1 power line to energize the control circuitry 26 of the electronic thermostat controller 10 via the switch control line 40 through the contact C of the switch II, the door sensor switch 230, the contacts 238 and 246 of the locking member switch 232, and through the timer 52 upon appropriate setting of the timer 52.

Thus, as discussed hereinbefore, the self-clean cycle of the oven continues throughout the self-cleaning interval as set on the timer 52 with the electronic thermostat controller 10 maintaining a self-cleaning temperature of 900° throughout the cleaning cycle. At the end of the cleaning cycle, the timer 52 is deactuated and opens the circuit path to the control circuitry 26 and the oven begins to cool down from the cleaning temperature of approximately 900°.

When the operator desires to open the oven door 206, the selector 18 is positioned to the off position as discussed hereinbefore in connection with FIG. 1 with the electronic thermostat control 10 at outputs 30 and 32 providing energizing signals to the switching device 34 when the oven temperature is below 625° and de-energizing signals to the switching device 34 when the oven temperature is above 625°.

The switch contact C of the switch III is connected to control a solenoid unlock actuator 248 with the switch contact C being connected through a solenoid coil 250 to the N power line. The solenoid unlock actuator 248 includes an unlock actuator member 252 pivotally attached at 254 to the locking member 200. Upon the energization of the solenoid unlock actuator 248, the unlock actuator member 252 is moved to the right in FIG. 3 to pivot the locking member 200 into the unlocked door position with the locking link member 212 moving to the latched position with respect to the latching pin 220 and holding the locking member 200 in the unlocked position.

Thus, when the oven selector 18 is set to the off position after a clean cycle, if the oven temperature is below 625°, the switching device 34 is actuated by the electronic thermostat control circuit 10 and the switching device 34 connects the L1 power line through the C contact of the switch III to energize the solenoid actuator 248 to unlock the oven door 206. With the selector 18 in the off position, the switch I is closed and connects the L1 power line through the locking link member sensor switch 222 to the switched control line 40 to energize the control circuitry 26. The locking link member 212 in the unlocked position opens the switch 222 by contacting the switch actuator 224. Conversely, the switch 222 is closed to provide the connection of the L1 power line to the switched control line 40 when the locking link member 212 is not in contact with the switch actuator 224 corresponding to any position of the locking member 200 in which the locking link member 212 does not latch the locking member 200 to the unlocked position. If the selector 18 is positioned in the off position and the oven temperature is above 625° F., the control circuitry 26 will not actuate the switching device 34 and consequently the solenoid actuator 248 will be de-energized and the locking member 200 will remain in the door locking position until the oven temperature drops below 625° F.

While there has been illustrated and described various embodiments of the present invention, it will be apparent that various changes and modifications will occur to those skilled in the art. For example, while the control arrangements of FIGS. 1–3 have been described relating to an electric oven, it should be realized that the present invention is also applicable to gas oven control wherein the switching device 34 is utilized to control gas flow control devices to gas burners.

Further, it should be realized that the control arrangement of the present invention is also applicable to control electric ovens of the type utilizing heating elements in addition to the bake and broil elements for self-cleaning operation and to electric ovens that have different cleaning modes than a clean cycle wherein both the bake and broil elements are simultaneously energized. Concerning the door latch arrangements discussed in connection with FIGS. 1 and 2, it should be realized that the locking member 56 is capable of interacting with the door latch arrangement of the oven in various different manners in accordance with the principles of the present invention.

For example, and referring to U.S. Pat. No. 4,013,312, the control arrangement of the present invention is applicable to the door latch and locking structure with the locking member 56 of FIGS. 1 and 2 of the present invention corresponding to the locking rod 66 of U.S. Pat. No. 4,013,312 and the door latch 60 and 160 of the present invention corresponding to the latch assembly 40 of U.S. Pat. No. 4,013,312. In one specific embodiment, a latch assembly similar to the latch assembly 40 of U.S. Pat. No. 4,013,312 includes an upstanding edge portion against which the locking member 56 abuts with the locking member 56 being extended over the latch assembly and past the upstanding edge portion and over a lowered portion of the latch assembly 40 with the locking member 56 positioned to a forward, locking position. Conversely, with the locking member 56 in a rearward, unlocked position, the upstanding edge position of the latch assembly 40 is not engaged by the locking member 56. The locking member verification switch 50 is one specific embodiment and for operation with the latch arrangement of U.S. Pat. No. 4,013,312 is positioned on the latch assembly 40 in a position proximate the cutout 74 in FIG. 2 to be actuated by the end of the locking member 56 when provided for the locking rod 66 of FIG. 2.

Further, and referring now to FIG. 3 of U.S. Pat. No. 3,469,568, the control arrangement of the present invention in another specific embodiment is applicable to the latching rod 94 and the lock member 90 of U.S. Pat. No. 3,469,568 with the latching rod 94 corresponding to the locking member 56 of the present invention and the lock member 90 corresponding to the door latch 60 of the present invention. The latching rod 94 is moved to an obstructing position of the lock member 90 at 97 in the locked position to prevent movement of the lock member 90. The lock member verification switch 50 is then mounted on the lock member 90 to be engaged by the latching rod 94.

In another specific embodiment and referring now to U.S. Pat. No. 3,362,398, the pivoted bolt member 50 of FIG. 3 in U.S. Pat. No. 3,362,398 is moved into obstructing relationship with the door latching mechanism 33. The pivoted bolt member 50 corresponds to the locking member 56 of the present invention and the door latching mechanism 33 corresponds to the door latch 60 of the present invention. In FIG. 3 of U.S. Pat. No. 3,362,398, the lock member verification switch 50 would be mounted to be engaged by the hook portion 54 of the pivoted bolt member 50.

Considering now specific embodiments of the electronic thermostat control 10 of the present invention, oven control arrangements as generally shown in U.S. Pat. Nos. 3,980,420, 3,946,200 and 3,632,986 are suitable to practice the present invention. However, it should be understood that various other types of electronic control arrangements are useful to practice the present invention.

Further, it should also be understood that the control arrangement of the present invention is also useful in connection with apparatus other than thermostatically controlled apparatus. For example, the present invention is also useful with apparatus having a controlled closure device and the apparatus controlling process functions such as radiation levels, pressure, humidity, chemical process characteristics and gaseous product concentrations. Thus, if the apparatus is of the type controlling pressures within a vessel having a closure device, the electronic control 10 would function as a pressure controller to control valves and the like.

It is intended in the appended claims to cover all such changes and modifications as fall within the true spirit and scope of the present invention.

What is claimed and desired to be secured by Letters Patent of the United States is:

1. An interlock arrangement for a self-cleaning oven having a frame defining an oven cavity, an oven door movably mounted with respect to the frame and movable between open and closed positions, oven cavity heat generating apparatus, an oven mode and temperature selector arrangement, and a temperature control arrangement responsive to the oven mode and temperature selector arrangement for controlling operation of the heat generating apparatus, said interlock arrangement comprising:

oven door locking means carried by the oven frame and comprising an elongated locking member having a door engaging portion at one extreme end of said locking member, said locking member being movable between a door unlocked position and a door locked position;

means carried by the oven door and adapted for cooperative engagement by said locking member; and locking control means for controlling operation of said oven door locking means, said oven door locking means further comprising means for latching said locking member to said unlocked door position when said locking member is positioned to said unlocked door position, said locking control means comprising first actuating means for releasing said locking member from said latched unlocked door position and second actuating means for moving said locking member from said locked door position to said unlocked door position, said first actuating means comprising means for biasing said control member to said locked door position when said locking member is released from said latched unlocked position, said locking control means further comprising switch verification means responsive to and being directly engaged by said locking member and the oven door for providing a closed circuit path when the oven door is closed and said locking member is not in said locked door position and for providing an open circuit path when the oven door is opened or the locking member is in said door locking position, the oven mode and temperature selector arrangement being responsive to a predetermined clean mode setting to provide an electrical energizing supply to said switch verification means, said switch verification means being connected in series connection with said electrical energizing supply and said first actuating means, said first actuating means being energized through said switch verification means to release said locking member from said latched unlocked door position when the oven mode and temperature selector arrangement is set to the clean mode, said oven door is in the closed position and said locking member is not in said door locked position, said first actuating means being de-energized when said locking member moves to said door locked position in response to said switch verification means being in said open circuit path condition, said oven mode and temperature selector arrangement further being responsive to a predetermined door unlock mode setting to connect an electrical energizing switched supply line to said second actuating means, said locking control means further comprising latch verification switch means being responsive to said locking member being in said latched unlocked position for providing an open circuit path when said locking member is in said latched unlocked position, the oven mode and temperature selector arrangement further being responsive when set to the predetermined door unlock mode to provide an electrical energizing supply through said latch verification switch means to energize the temperature control arrangement, the temperature control arrangement being responsive to the oven mode and temperature selector arrangement being in the predetermined unlock door mode to provide on said electrical energizing switched supply line an energizing signal when the oven temperature is below a predetermined oven door unlock temperature and a de-energizing signal when the oven temperature is above said predetermined oven door unlock temperature, said second actuating means being responsive to the energizing signal on said electrical energizing switched supply line to move said locking member from said locked door position to said unlocked door position.

2. The interlock arrangement of claim 1 wherein said locking member latching means comprises a latch link having a first end being coupled to said locking member and a latch engaging member at the opposite end, said locking member latching means further comprising holding means carried by the oven frame for energizing said latch engaging member of said latch link when said locking member is in said unlocked door position.

3. The interlock arrangement of claim 2 wherein said locking member latching means further comprises means for biasing said latch link into said latching position.

4. The interlock arrangement of claim 3 wherein said first actuating means comprises a first actuating member arranged to engage said latch link.

5. The interlock arrangement of claim 1 wherein said second actuating means comprises a second actuating member coupled to said locking member.

6. The interlock arrangement of claim 1 wherein said switch verification means comprises a single-pole, single-throw door monitor switch and a single-pole, double-throw locking member monitor switch, said door monitor switch being connected in series with the common contact of said locking member switch, said first actuating means being connected to a first switch contact of said locking member monitor switch that provides a closed circuit path with said common contact when said locking member is not in said locked door position, said second switch contact of said locking member monitor switch providing a closed circuit path with said common contact when said locking member is in said locked door position.

7. The interlock arrangement of claim 6 wherein said oven mode and temperature selector arrangement includes a timer having timer switch means providing a closed circuit path when said timer is set in the clean mode.

8. The interlock arrangement of claim 7 wherein said timer switch means is connected between the temperature control arrangement and said second switch contact of said locking monitor switch.

9. The interlock arrangement of claim 1 wherein the door unlock mode is the off mode position of the oven mode and temperature selector arrangement.

10. An interlock arrangement for a self-cleaning oven having a frame defining an oven cavity, an oven door movably mounted with respect to the frame and movable between open and closed positions, oven cavity heat generating apparatus, an oven mode and temperature selector arrangement, and a temperature control arrangement responsive to the oven mode and temperature selector arrangement for controlling operation of the heat generating apparatus, said interlock arrangement comprising:

oven door locking means carried by the oven frame and comprising an elongated locking member having a door engaging portion at one extreme end of said locking member, said locking member being movable between a door unlocked position and a door locked position;

means carried by the oven door and adapted for cooperative engagement by said locking member; and locking control means for controlling operations of said oven door locking means, said oven door locking means further comprising means for latching said locking member to said unlocked door position when said locking member is positioned to said unlocked door position, said locking control means comprising first actuating means for releasing said locking member from said latched unlocked door position and second actuating means for moving said locking member from said locked door position to said unlocked door position, said first actuating means comprising means for biasing said control member to said locked door position when said locking member is released from said latched unlocked position, said locking control means further comprising switch verification means responsive to and being directly engaged by said locking member and the oven door for providing a first predetermined circuit path when the oven door is closed and said locking member is not in said locked door position with said switch verification means not being engaged by said locking member, said switch verification means providing a second predetermined circuit path when the oven door is opened or the locking member is in said door locking position, said first actuating means being energized through said switch verification means to release said locking member from said latched unlocked door position when the oven mode and temperature selector arrangement is set to a clean mode, said oven door is in the closed position and said locking member is not in said door locked position, said first actuating means being de-energized when said locking member moves to said door locked position in response to said switch verification means being engaged by said locking member, said locking control means further comprising latch verification switch means being responsive to said locking member being in said latched unlocked position for providing a predetermined circuit path when said locking member is in said latched unlocked position, said latch verification switch means being effective in combination with the temperature control arrangement in a predetermined unlock door mode to energize said second actuating means when the oven temperature is below a predetermined oven door unlock temperature.

11. An interlock arrangement for apparatus having a frame and a closure device defining an apparatus cavity, a selectively operable apparatus cavity parameter establishing arrangement, an apparatus mode and parameter set point selector arrangement and a parameter control arrangement responsive to the apparatus mode and parameter set point selector arrangement for controlling operation of the apparatus cavity parameter establishing arrangement, said interlock arrangement comprising:

closure device locking means carried by the apparatus frame and comprising an elongated locking member having a closure device engaging portion at one extreme end of said locking member, said locking member being movable between a closure device unlocked position and a closure device locked position;

means carried by the closure device and adapted for cooperative engagement by said locking member; and locking control means for controlling operations of said closure device locking means, said closure device locking means further comprising means for latching said locking member to said unlocked closure device position when said locking member is positioned to said unlocked closure device position, said locking control means comprising first actuating means for releasing said locking member from said latched unlocked closure device position and second actuating means for moving said locking member from said locked closure device position to said unlocked closure device position, said first actuating means comprising means for biasing said control member to said locked closure device position when said locking member is released from said latched unlocked position, said locking control means further comprising switch verification means responsive to and being directly engaged by said locking member and the closure device for providing a first predetermined circuit path when the closure device is in a closed position and said locking member is not in said locked closure device position with said switch verification means not being engaged by said locking member, said switch verification means providing a second predetermined circuit path when the closure device is in an opened position or the locking member is in said closure device locking position, said first actuating means being energized through said switch verification means to release said locking member from said latched unlocked closure device position when the apparatus mode and parameter set point selector arrangement is set in a first predetermined operational mode, said closure device is in the closed position and said locking member is not in said closure device locked position, said first actuating means being de-energized when said locking member moves to said closure device locked position in response to said switch verification means being engaged by said locking member, said locking control means further comprising latch verification switch means being responsive to said locking member being in said latched unlocked position for providing a predetermined circuit path when said locking member is in said latched unlocked position, said latch verification switch means being effective in combination with the parameter control arrangement in a predetermined unlock closure device mode to energize said second actuating means when the value of the parameter is below a predetermined door closure unlock level.

* * * * *